US006823777B2

(12) United States Patent
Blinn et al.

(10) Patent No.: US 6,823,777 B2
(45) Date of Patent: Nov. 30, 2004

(54) APPARATUS FOR COMPRESSING OBJECTS AND HIGH-PRESSURE PRESS

(75) Inventors: Klaus Blinn, Rödermark (DE); Manfred Klapper, Weilmünster (DE); Viktor Gliha, Hanau (DE)

(73) Assignee: Framatome ANP GmbH, Erlangen (DE)

( * ) Notice: Subject to any disclaimer, the term of this patent is extended or adjusted under 35 U.S.C. 154(b) by 0 days.

(21) Appl. No.: 10/036,254

(22) Filed: Oct. 22, 2001

(65) Prior Publication Data

US 2002/0148367 A1 Oct. 17, 2002

Related U.S. Application Data

(63) Continuation of application No. PCT/DE00/01275, filed on Apr. 25, 2000.

(30) Foreign Application Priority Data

Apr. 22, 1999 (DE) ..... 199 18 333

(51) Int. Cl.[7] ..... B30B 5/00
(52) U.S. Cl. ..... 100/238; 100/269.01
(58) Field of Search ..... 100/238, 269.01, 100/260.18, 269.02, 214, 295, 240, 245

(56) References Cited

U.S. PATENT DOCUMENTS

| | | | | | |
|---|---|---|---|---|---|
| 1,782,103 | A | * | 11/1930 | Solbertg et al. | 100/269.21 |
| 3,416,439 | A | * | 12/1968 | Tezuka | 100/223 |
| 3,613,764 | A | * | 10/1971 | Guenard | 157/1.26 |
| 4,610,199 | A | | 9/1986 | Pols | |
| 4,768,430 | A | | 9/1988 | Yamamoto et al. | |
| 4,869,141 | A | * | 9/1989 | Klingel | 83/49 |
| 4,954,068 | A | * | 9/1990 | Brussel | 425/406 |
| 5,323,698 | A | | 6/1994 | Prevost | |
| 5,622,105 | A | * | 4/1997 | Bergman | 100/245 |

FOREIGN PATENT DOCUMENTS

| | | | |
|---|---|---|---|
| GB | 1513367 | | 6/1978 |
| GB | 2066148 A | * | 7/1981 |

* cited by examiner

*Primary Examiner*—Allen Ostrager
*Assistant Examiner*—Shelley Self
(74) *Attorney, Agent, or Firm*—Laurence A. Greenberg; Werner H. Stemer; Gregory L. Mayback

(57) ABSTRACT

An apparatus for compressing objects includes a base plate, a frame and a ram head guided so as to be displaceable on the frame. Forces may occur in the peripheral direction of the ram head during the compression of bulky objects. The ram head is rotatable relative to the frame in order to reduce the forces introduced into the frame.

15 Claims, 1 Drawing Sheet

APPARATUS FOR COMPRESSING OBJECTS AND HIGH-PRESSURE PRESS

CROSS-REFERENCE TO RELATED APPLICATION

This application is a continuation of International Application No. PCT/DE00/01275, filed Apr. 25, 2000, which designated the United States.

BACKGROUND OF THE INVENTION

FIELD OF THE INVENTION

The present invention relates to an apparatus and a hydraulic high-pressure press for compressing objects, including a base plate, a frame and a ram head guided so as to be displaceable on the frame.

Such apparatuses have been disclosed in different configurations and are suitable for compressing various types of objects. For example, apparatuses of a lighter type of construction for strictly limited and small compressive-force requirements are known. Those apparatuses are constructed essentially as screw clamps, as in UK Patent GB 1 513 367. However, apparatuses suitable for compressing crumple drums filled with waste must satisfy stringent design criteria with regard to compressive force and construction. In particular, that waste may also be waste which is contaminated radioactively or in another way and which is enclosed in casks or other suitable containers.

During the operation of the press for the compression, forces acting in the peripheral direction may be applied to the ram head. Those forces are produced by bulky parts (e.g. steel pipes) in the crumple drum and are introduced into the frame of the apparatus. Therefore, in the known apparatuses, the frame has to be constructed accordingly and have larger dimensions, so that higher construction costs arise. Despite that expensive construction, damage due to the forces acting in the peripheral direction cannot be ruled out. That is because bulky steel parts or tubular parts in particular can divert considerable forces in the peripheral direction.

SUMMARY OF THE INVENTION

It is accordingly an object of the invention to provide an apparatus for compressing objects and a high-pressure press, which overcome the hereinafore-mentioned disadvantages of the heretofore-known apparatuses of this general type and which reduce forces introduced into a frame by a ram head.

With the foregoing and other objects in view there is provided, in accordance with the invention, an apparatus for compressing objects, comprising a base plate, a frame disposed on the base plate and a ram displaceably guided on the frame.

A ram head is attached to the ram and rotatable relative to the frame. The ram head has a centrally disposed bolt. The bolt has one end rotationally connected to the ram for rotationally mounting the ram head on the ram. The bolt has another end with a threaded extension to be rotationally fixed to the ram head for exchanging the ram head.

As soon as bulky parts are wedged during the compression and produce a force in the peripheral direction, the ram head is rotated relative to the frame and thus relative to the base plate. As a result, the jammed bulky parts are freed, so that force no longer acts in the peripheral direction. The rotatable mounting of the ram head prevents forces which act in the peripheral direction from being introduced into the frame, which may therefore be constructed for lower loads.

The apparatus therefore has a ram on which the ram head is mounted in a rotatable manner. The ram serves to apply the necessary force to the ram head. Known apparatuses may be retrofitted due to the separation between the ram and the ram head. Additionally, it is possible to exchange the ram head.

Furthermore, the ram head thus has a centrally disposed bolt which is connected to the ram in a rotatable manner. The weight of the ram head is carried by the bolt, which is mounted so as to be rotatable on the ram in a simple manner and with little outlay.

In accordance with another feature of the invention, the bolt is provided at one end with a threaded extension for fastening to the ram head in a rotationally locked manner. The threaded extension permits quick and simple fastening and quick exchange of the bolt.

In accordance with a further feature of the invention, the bolt is acted upon with prestress. The prestress is advantageously selected to be greater than the force due to the weight of the ram head. In each position, therefore, the ram head is held in a defined position on the ram and does not just bear against the ram during the compression. As a result, damage in the region of the contact surfaces between the ram and the ram head is reliably avoided.

In accordance with an added feature of the invention, the one end of the bolt is supported on the ram through a disk and studs. This one end of the bolt is connected to the ram in a rotatable manner. The support through the disk and the studs permits a simple and cost-effective construction without special mountings.

In accordance with an additional feature of the invention, the bolt is rotatable relative to the disk. A relative movement between the studs and the disk and between the disk and the ram does not take place. Wear due to rotation of the ram head relative to the ram is therefore only present in the region of the disk and of the bolt, both of which can easily be exchanged.

In accordance with yet another feature of the invention, the studs are supported on another disk resting on the ram. As soon as a movement of the studs relative to the ram occurs in individual cases, there is no direct contact between the studs and the ram. Damage can only occur to the studs and the disk, which can be changed quickly and simply.

In accordance with yet a further feature of the invention, the studs for supporting the ram head engage in an encircling groove. This encircling groove laterally guides the studs and thus fixes the ram head.

In accordance with yet an added feature of the invention, the studs are prestressed by plate or Belleville springs. Belleville springs permit large prestressing forces in a small space and with low costs. The prestressing force can be changed quickly and simply by exchanging the Belleville springs, without complicated measures.

In accordance with yet an additional feature of the invention, the ram and the ram head are centered relative to one another through an extension. A defined position of the ram head relative to the frame is thereby ensured in every rotary position. The extension at the same time absorbs any transverse forces which may arise and relieves the bolt which connects the ram head to the ram.

In accordance with again another feature of the invention, the ram can be moved hydraulically with the ram head substantially in the vertical direction, with only the ram head being rotatable relative to the frame. That is to say, the ram can be moved up and down with the ram head, for example by an appropriate hydraulic apparatus. In this case, the ram, as a rule, is not rotatable, but rather only the ram head is rotatable.

With the objects of the invention in view, there is also provided a high-pressure press, in particular a hydraulic high-pressure press, for compressing objects, in particular for compressing containers containing bulky parts. The press comprises a base plate, a frame disposed on the base plate, a ram displaceably guided on the frame and a ram head attached to the ram for rotation relative to the frame. The ram head has a centrally disposed bolt with one end rotationally connected to the ram for rotationally mounting the ram head on the ram.

Since a high-pressure press, in particular a hydraulic high-pressure press, can produce compressive forces of several thousand English, American or Metric tons, in particular in the region of 2000 tons, it is possible, when bulky parts are being compressed, for these bulky parts to become wedged and produce forces in the peripheral direction which lie within a range of between several tons and several hundred tons, in particular within a range of 50 to 200 tons. As soon as such bulky parts are wedged, the ram head is rotated relative to the frame and thus relative to the base plate, so that the jammed bulky parts are freed and the forces in the peripheral direction are considerably reduced. In particular, within the range of the compressive-force stress mentioned by way of example of such a high-pressure press and the associated possible forces mentioned by way of example in the peripheral direction, this structure achieving the object of the invention results in considerable advantages in the construction of such a high-pressure press as well as when carrying out a press operation with such a high-pressure press.

In accordance with a concomitant feature of the invention, in the high-pressure press, in particular in a hydraulic high-pressure press, the bolt is provided at another end with a threaded extension for fastening to the ram head in a rotationally locked manner, so that the ram head can be exchanged. This is because, in particular during high compressive-force stress in a high-pressure press, it is especially advantageous if the ram head can be exchanged after it has possibly been subjected to wear. This has the particular advantage that, to this end, the entire ram would not need to be exchanged or removed at considerable cost and reinstalled again in order to attach a new ram head. On the other hand, a ram head screwed-in according to the invention can easily be released from the ram and thus exchanged.

Other features which are considered as characteristic for the invention are set forth in the appended claims.

Although the invention is illustrated and described herein as embodied in an apparatus for compressing objects and a high-pressure press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
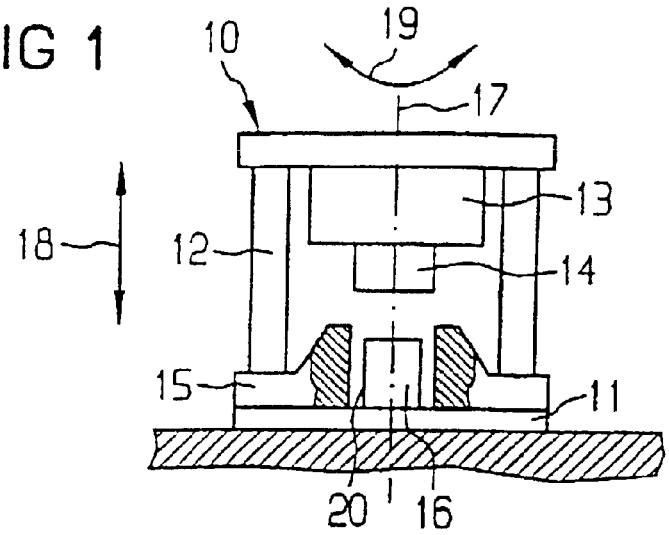
FIG. 1 is a fragmentary, diagrammatic, partly-sectional view of an apparatus or high-pressure press according to the invention.

Referring now to the figures of the drawings in detail and first, particularly, to FIG. 1 thereof, there is seen an apparatus 10 according to the invention which includes a base plate 11, a frame 12, a ram 13 and a ram head 14. A holder 15 which is also provided has an interior space 20 into which a cask 16 is inserted. The ram head 14 is guided so as to be displaceable in the direction of an arrow 18 relative to the frame 12. The ram 13 serves to move the ran head 14 and therefore the ram 13 contains suitable non-illustrated devices. When the cask 16 is being compressed, bulky objects contained in the cask 16 can apply forces to the ram head 14 in the peripheral direction. This is essentially due to the fact that the compressive force on the object to be compressed (e.g. a cask which can contain such objects) is initiated in a non-concentric manner by the bulky parts.

In a high-pressure press, in particular a hydraulic high-pressure press, compressive forces in the range of several thousand English, American or Metric tons, primarily in the range of about 2000 tons, are applied to an object to be compressed. The result of this is that forces from one ton up to several hundred tons may arise in the peripheral direction. The ram head 14 is therefore mounted on the ram 13 in such a way as to be rotatable about its center axis 17 in the direction of an arrow 19. As a result, the ram head 14 is rotatable relative to the frame 12. Possible forces acting in the peripheral direction are thus considerably reduced, in particular in a hydraulic high-pressure press.

Figure 2:
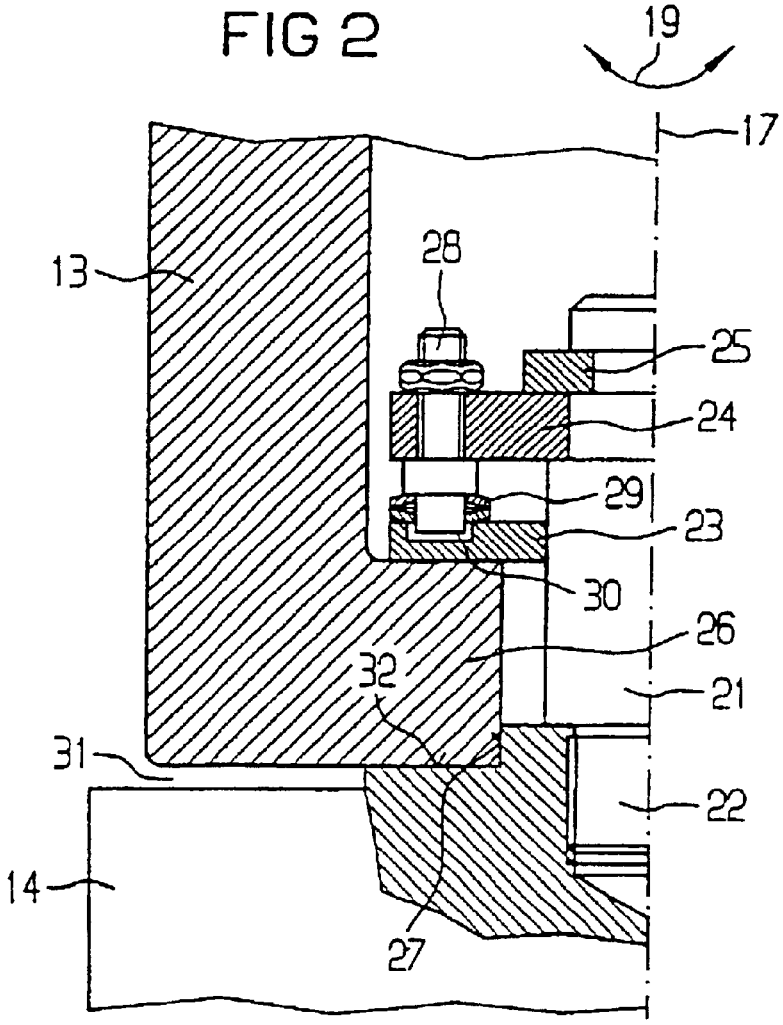
FIG. 2 is an enlarged, fragmentary, partly-sectional representation of a fastening of a ram head on a ram in the apparatus or high-pressure press.

FIG. 2 shows details of the connection between the ram 13 and the ram head 14. The ram head 14 has a centrally disposed bolt 21 which is provided with a threaded extension 22 for fastening to the ram head 14 in a rotationally locked manner. A disk 24 which is disposed on the other end of the bolt 21 is connected to the bolt 21 in such a way that it can rotate, but is axially fixed by a ring 25. A plurality of studs 28 which are distributed uniformly over the periphery are disposed on the disk 24. The studs 28 are supported in an encircling groove 30 of another disk 23. This disk 23 rests on the ram 13.

As soon as a force is produced in the peripheral direction of the ram head 14 during the compression, the ram head 14 is rotated together with the bolt 21. The disk 24 and the studs 28 do not rotate in the ideal case. If a rotary movement of the disk 24 in the direction of the arrow 19 should occur contrary to expectation, the studs 28 are reliably guided by the encircling groove 30. Rotation of the ram head 14 about its center axis 17 in the direction of the arrow 19 is always possible. Wear of the ram 13 or of the ram head 14 is reliably avoided by the disks 23, 24 and the studs 28.

The studs 28 may be prestressed by Belleville or plate springs 29. This prestress acts upon the bolt 21 and is selected to be greater than the force due to the weight of the ram head 14. FIG. 2 shows that the ram head 14 is pressed from below against the ram 13 by the prestress due to the Belleville or plate springs 29. The ram head 14 is therefore always in an exactly defined position relative to the ram 13. Damage to the ram 13 or the ram head 14 during the compression is therefore ruled out.

An extension 27 on the ram head 14 serves for centering between the ram 13 and the ram head 14. The extension 27 accommodates an edge 26 on the ram 13. If need be, the extension 27 absorbs transverse forces occurring during the compression and thereby relieves the bolt 21. The force required for the compression is applied through a contact surface 32 between the ram 13 and the ram head 14. An intermediate space 31 is provided to the side of the extension 27, between the ram 13 and the ram head 14. This intermediate space 31 reduces the contact surface 32 between the ram 13 and the ram head 14. As a result, the area to be worked or processed is reduced, resulting in low manufacturing costs. The force required for rotating the ram head 14 in the direction of the arrow 19 is also reduced, so that only very small forces are introduced into the frame 12 in the peripheral direction.

Due to the rotatability of the ram head 14 relative to the frame 12, the forces introduced into the frame 12 are substantially reduced and are completely removed in the ideal case. The frame 12 can therefore be constructed for lower loads.

We claim:

1. An apparatus for compressing objects, comprising:

a base plate;

a frame disposed on said base plate;

a ram displaceably guided on said frame; and a ram head concentrically mounted to said ram and rotatable relative to said frame, said ram head having a centrally disposed bolt, said bolt having one end rotationally connected to said ram for rotationally mounting said ram head on said ram, and said bolt having another end with a threaded extension to be rotationally fixed to said ram head for exchanging said ram head.

2. The apparatus according to claim 1, wherein said bolt is prestressed.

3. The apparatus according to claim 2, wherein said bolt has a prestress greater than a force due to a weight of said ram head.

4. The apparatus according to claim 1, including a disk having studs disposed thereon, said disk and said studs supporting said one end of said bolt on said ram.

5. The apparatus according to claim 4, wherein said bolt is rotatable relative to said disk.

6. The apparatus according to claim 4, including another disk resting on said ram, said studs supported on said other disk.

7. The apparatus according to claim 4, wherein said studs for supporting said ram head are engaged in an encircling groove.

8. The apparatus according to claim 4, including at least one plate spring prestressing a respective one of said studs.

9. The apparatus according to claim 1, including an extension mutually centering said ram and said ram head.

10. The apparatus according to claim 1, wherein said ram is substantially vertically movable hydraulically with said ram head, with only said ram head being rotatable relative to said frame.

11. A high-pressure press for compressing objects, the press comprising:

a base plate;

a frame disposed on said base plate;

a ram displaceably guided on said frame; and a ram head attached to said ram for rotation relative to said frame, said ram head having a centrally disposed bolt with one end rotationally connected to said ram for rotationally mounting said ram head on said ram.

12. The high-pressure press according to claim 11, wherein said bolt has another end with a threaded extension to be rotationally fixed to said ram head for exchanging said ram head.

13. The high-pressure press according to claim 11, wherein said ram is hydraulically actuated.

14. The high-pressure press according to claim 11, wherein the objects are containers containing bulky parts.

15. An apparatus for compressing objects, comprising:

a base plate;

a frame disposed on said base plate;

a ram having an axis and being displaceably guided on said frame along said axis;

a ram head coxaially attached to said ram and rotatable relative to said frame; and a bolt disposed coaxially with said ram and said ram head, said bolt having one end connected to said ram and another end with a threaded extension to be rotationally fixed to said ram head for exchanging said ram head.

* * * * *